United States Patent [19]

Hisadome

[11] 4,409,575

[45] Oct. 11, 1983

[54] ELECTROMAGNETIC CONTACTOR

[75] Inventor: Masanao Hisadome, Kuwana, Japan

[73] Assignee: Tokyo Shibaura Denki Kabushiki Kaisha, Kawasaki, Japan

[21] Appl. No.: 286,659

[22] Filed: Jul. 24, 1981

[30] Foreign Application Priority Data

Aug. 7, 1980 [JP] Japan ..... 55-111842[U]
Dec. 20, 1980 [JP] Japan ..... 55-183572[U]

[51] Int. Cl.[3] ..... H01H 9/26
[52] U.S. Cl. ..... 335/160; 200/50 C
[58] Field of Search ..... 335/160, 159; 200/50 C

[56] References Cited

U.S. PATENT DOCUMENTS 3,240,889 3/1966 Lawrence et al. ..... 335/160
3,536,868 10/1970 Lawrence et al. ..... 335/160
3,592,985 7/1971 Arneberg et al. ..... 200/50 C
3,735,295 5/1973 Grunert et al. ..... 335/160
3,824,510 7/1974 Kold et al. ..... 335/160

FOREIGN PATENT DOCUMENTS 54-72664 11/1977 Japan .

*Primary Examiner*—Harold Broome
*Attorney, Agent, or Firm*—Oblon, Fisher, Spivak, McClelland & Maier

[57] ABSTRACT

An electromagnetic contactor provided with two units of electromagnetic contactors. When one of units is excited to move a movable iron core, the movement of movable iron core forces a roller, which is arranged between two units, into the other unit to prevent a movable iron core of the other unit from being moved.

2 Claims, 11 Drawing Figures

ELECTROMAGNETIC CONTACTOR

BACKGROUND OF THE INVENTION

The present invention relates to an electromagnetic contactor having two units of electromagnetic contactors in which an interlock mechanism provided between the two units is set in such a way that one of units is kept inoperative while the other is operating.

Electromagnetic contactors of this type are already well known. When the direction in which a motor is rotated is reversed, for example, the electromagnetic contactor is effectively employed to prevent a power source from being short-circuited in such a way that one of units for rotating the motor in a direction is closed simultaneously with the other for rotating the motor is opposite direction. One of these electromagnetic contactors which have been widely employed is shown in FIG. 1. An electromagnetic contactor unit 12 for rotating the motor in a direction and another electromagnetic contactor unit 13 for rotating the motor in opposite direction are mounted on a common base 14. Between units 12 and 13 is also mounted an interlocking device 15 on the base 14. Each of units 12 and 13 includes a fixed iron core 16, a movable iron core 17, an exciting coil 20 wound around the fixed iron core 16, a contact mechanism 21, a spring 22 for urging the movable iron core 17 upwards, and a housing 23 made of plastics and enclosing these components. Coil 20 and contact mechanism 21 are provided with electrical members such as terminals connected to an external circuit, and at least a pair of contacts are arranged in the contact mechanism 21 to be opened and closed according to the movement of movable iron core 17. However, these electrical members and contacts are omitted in FIG. 1 because they have no relation with the gist of the present invention. When coils 20 of units 12 and 13 are excited, movable iron cores 17 are drawn downwards to close pairs of contacts in contact mechanisms. The interlocking device 15 serves to prevent both contact mechanisms 21 from being closed simultaneously. The interlocking device 15 includes a bearing stand 24 erected on the base 14, and an interlocking member 26 which is fitted onto a shaft 25 attached to the bearing stand 24 and rotatable in both of clockwise and counterclockwise directions. This interlocking device 26 has arms 30*a* and 30*b* each having a same length and extending in opposite directions to project into the inside of housing 23 of units 12 and 13 through a window 27, which is provided in opposite side walls of housings 23, respectively. Each of arms 30*a* and 30*b* extends under a movable rod 31 attached to the movable iron core 17. When the unit 12 is excited and the movable iron core 17 is lowered, the pair of contacts inside are closed, the left arm 30*a* is pressed downwards, the interlocking member 26 is rotated in counterclockwise direction, and the right arm 30*b* is lifted to contact the lower end of movable rod 31 of unit 13 at the foremost end thereof, preventing the movable rod 31 from being lowered. Therefore, the pair of contacts are kept opened inside the contact mechanism 21 of unit 13 even when the unit 13 is excited. It is because iron cores 16 and 17 of unit 12 are closely contacted with each other while those of unit 13 are separated from each other and the pulling force between iron cores 16 and 17 of unit 12 is larger than that between those of unit 13 to thereby keep iron cores 16 and 17 of unit 12 not separated by the excitation of unit 13.

As described above, conventional electromagnetic contactors each having a mechanical interlock mechanism are effective in operation. However, control circuits in the field of power transmission and distribution and in various plants have become complicated these days in such a way that various electrical parts and instruments are attached to a power distribution or control board, and it has been therefore desired to make these various parts and instruments simple and small-sized. Same thing can be said about electromagnetic contactors. The inventor of the present invention reviewed conventional electromagnetic contactors with a mechanical interlock mechanism in detail and invented a structure which allows electromagnetic contactors each having a mechanical interlock mechanism to be simple and smaller-sized. When units 12 and 13 are not excited, both movable iron cores 17 are lifted by spring 22 to have a distance L from fixed iron cores 16, respectively. L is a range at which the movable iron core 17 and therefore the movable rod 31 can move, and can be called as the stroke of each of movable iron core 17 and movable rod 31. The shaft 25 of interlocking device 15 is arranged in the center between units 12 and 13 and in the center of stroke of movable rod 31. Even when the unit 12 is excited, the movable iron core 17 is lowered and the arm 30*a* is lowered while the arm 30*b* is lifted to contact the movable rod 31 of unit 13 preventing the movable rod 31 of unit 13 from being lowered, the arm 30*b* can not lift the movable rod 31 of unit 13 higher than the level of movable rod 31 of unit 12 unless the movable rod 31 of unit 12 is lowered by a distance larger than half the stroke thereof. Accordingly, the lowering distance which corresponds substantially to the half of stroke from the non-excited position of movable iron core 17 can be called as a play distance in interlocking operation.

The interlocking mechanism 15 of conventional electromagnetic contactor 10 has a larger play distance in the above-mentioned sense. In addition, the relatively bulky and complicated interlocking device 15 is arranged between both units thus making large the height and width of electromagnetic contactor 10. Further, assembly and adjustment of interlocking mechanism 15 are not easy. For the purpose of assembling and adjusting the interlocking device in such a way that the shaft 25 of interlocking device 15 is positioned in the center of stroke of lower end of movable rod 31, it is necessary to correctly mount the bearing stand 24, shaft 25 and interlocking member 26 on the base 14. These assembly and adjustment are not easy and take a long time because of many parts and dimension and assembly errors of related parts.

SUMMARY OF THE INVENTION

The object of the present invention is to provide an electromagnetic contactor smaller-sized and easier in assembly and adjustment and having two units of electromagnetic contactors one of which can be kept inoperative by a mechanical interlocking means during the operation of the other.

A further object of the present invention is to provide a mechanical interlock mechanism which is simple, compact and inexpensive.

The object of the present invention can be achieved by an electromagnetic contactor comprising two units of electromagnetic contactors each including a fixed iron core, a coil for exciting the fixed iron core, a movable iron core which is in a predetermined inoperative position when the fixed iron core is not excited but drawn to the fixed iron core when the fixed iron core is excited, and a spring means for urging the movable iron core to the inoperative position; a roller; a connecting member sandwiched between two units and having a through-groove which holds the roller in such a way that the roller can move in any direction toward both units; and holding means for pushing the roller toward the inoperative unit and holding the movable iron core in the inoperative position when the movable iron core of the other unit moves to the operative position.

When the electromagnetic contactor of the present invention is employed, the roller is pushed into the other unit by the movement of movable iron core caused when one unit is excited to thereby prevent the operation of the other unit, and the play distance along which the movable iron core moves until the roller starts to move from the inoperative position thereof can be made shorter. In addition, the mechanical interlock mechanism is simple and small, and assembly and adjustment of this electromagnetic contactor with the mechanical interlock mechanism is made easier accordingly.

DETAILED DESCRIPTION OF THE PREFERRED EMBODIMENT

Figure 1:
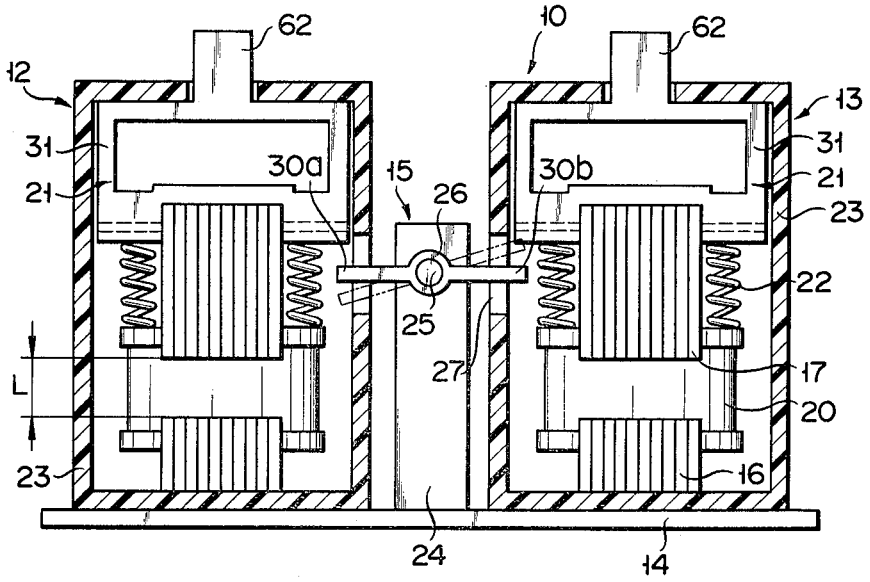
FIG. 1 PRIOR ART
FIG. 1 is a partially sectioned front view showing one of conventional electromagnetic contactors with a mechanical interlock mechanism.
Figure 2:
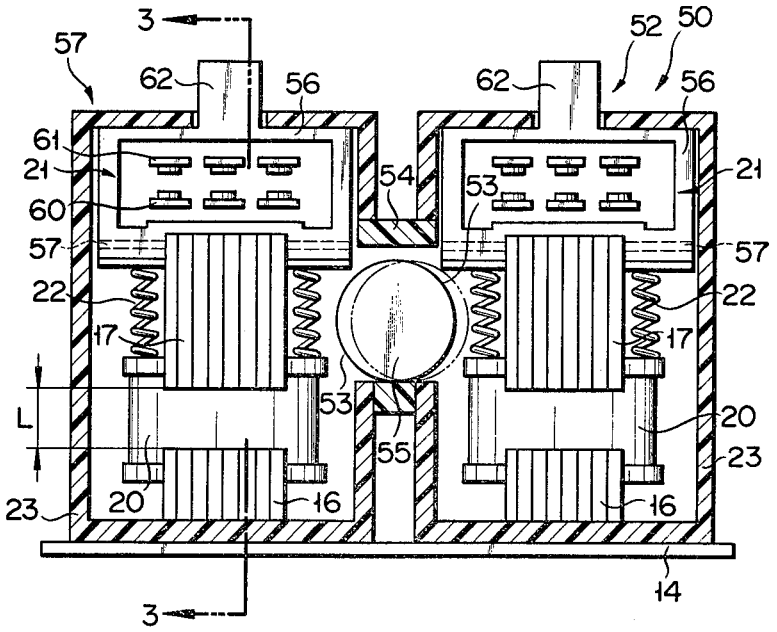
FIG. 2 is a partially sectioned front view showing an electromagnetic contactor with a mechanical interlock mechanism of the present invention not excited.

FIG. 2 shows an electromagnetic contactor 50 of the present invention. This electromagnetic contactor 50 has same units of electromagnetic contactors (which will be hereinafter referred to as unit or units) as those 12 and 13 housed in the electromagnetic contactor 10 shown in FIG. 1, in addition to a means for carrying out interlocking operation. Accordingly, those members which have same structure and function as in FIG. 1 are represented by same numerals. Three pairs of contacts housed in each of contact mechanisms 21 of FIG. 1 are shown with their supporting members excluded. The attachment of these pairs of contacts is shown in detail in FIG. 3. The electromagnetic contactor 50 shown in FIG. 2 includes windows 53 provided opposite to each other in side walls of housings 23 made of plastics (FIG. 4), first and second units 51 and 52 having substantially same construction as those shown in FIG. 1, a mechanical interlock mechanism including a connecting member 54 held by the windows 53, and a roller 55 fitted into the connecting member 54 so as to move in right and left directions in FIG. 2, that is, toward both units 51 and 52 and made of insulating and a slightly resilient material such as plastic and rubber.

Figure 3:
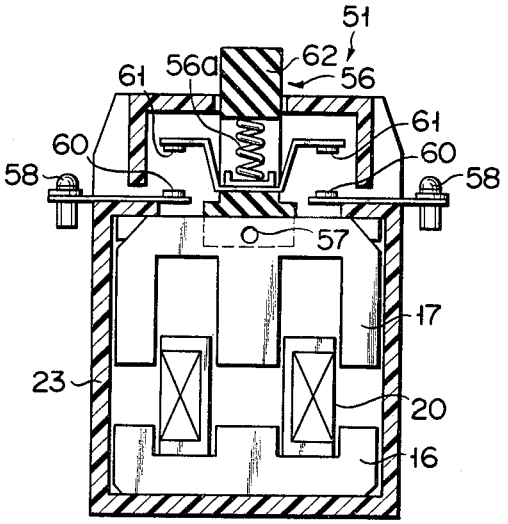
FIG. 3 is a partially sectioned front view showing the electromagnetic contactor of FIG. 2 in which two units of electromagnetic contactors employed are not excited.

FIG. 3 is a cross sectional view taken along a line 3—3 in FIG. 2 and showing the unit 51 not excited. As shown in FIG. 3, iron cores of E-type are employed as fixed and movable iron cores 16 and 17. A movable frame 56 of contact mechanism 21 is attached to the upper portion of movable iron core 17 by means of a pin 57. Fixed contacts 60 of contacts arranged in the contact mechanism 21 and connected to terminals 58 are attached to the housing 23, and movable contacts 61 are attached via a spring **56*a* to the movable frame or holding means 56**.

Figure 4:
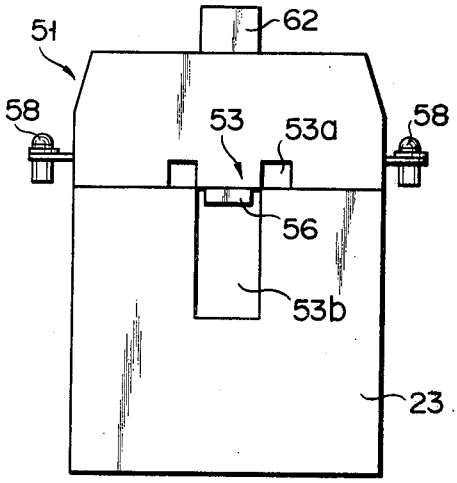
FIG. 4 is a side view of a unit shown in FIG. 3.

FIG. 4 shows a view taken seeing the unit 51 from the right side thereof in FIG. 2. The window 53 comprises first windows **53*a* and a second window 53*b* provided in the housing 23. The lower end portion of movable frame 56 attached to the movable iron core 17 is seen in the second window 53*b*. A projection 62 formed on the upper end of movable frame 56 extends through an upper opening of unit 51**.

Figure 5:
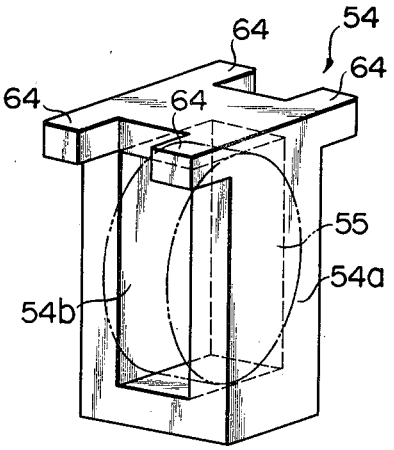
FIG. 5 is a perspective view showing a connecting member employed in the electromagnetic contactor of FIG. 2.
Figure 6:
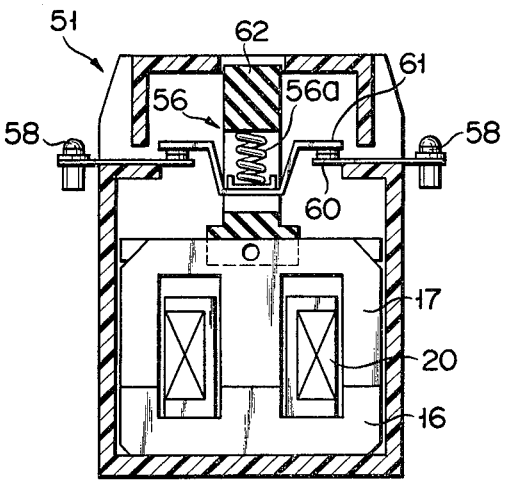
FIG. 6 is a partially sectioned front view showing units of FIG. 3 excited.

The connecting member 54 shown in FIG. 5 includes a body **54*a* of rectangular parallelepiped, four connecting projections 64 projecting in opposite directions from four corners or one end of body 54*a*, and a through-groove 54*b* formed in the body to be rectangular when seen from the direction in which connecting projections 64 project. Two of projections 64 which project in the same direction are fitted into first windows 53*a* shown in FIG. 4 while the other two into first windows 53*a* formed in the unit 52, so that the connecting member 54 is held between units 51 and 52 with its through-groove 54*b* aligned with second windows 53*b* of housings 23 of both units. The roller 55 inserted into the through-groove 54*b* of connecting member 54 shown in FIG. 2 is held there to be movable in right and left directions in FIG. 2. As apparent from FIGS. 2 and 5, the width of body 54*a* is smaller than the diameter of roller 55, so that both side portions of roller 55 appear outside the body 54*a*. The roller 55 positioned in the center of through-groove 54*b* of body 54*a* of connecting member 54 is shown by two-dot and dash lines in FIG. 5. When the roller 55 is in this position, both side portions thereof project into units 51 and 52**, respectively.

The operation of electromagnetic contactor 50 shown in FIG. 2 will be now described referred to FIGS. 2, 3, 6 and 7. FIGS. 2 and 3 show that units 51 and 52 are not excited with movable iron cores 17 and movable frames 56 lifted by springs 22 contacting inner surfaces of roofs of housings 23. As shown in FIG. 3, movable contacts 61 attached via the spring **56*a* to the movable frame 56 are separated, under this condition, from fixed contacts 60 attached to the housing 23 keeping the line between two terminals 58 opened. Projections 62 of movable frames 56 project outside showing that units 51 and 52 are kept inoperative. The roller 55** is kept, under this condition, movable freely in right and left directions along the through-groove 54*b* of connecting member 54.

Figure 7:
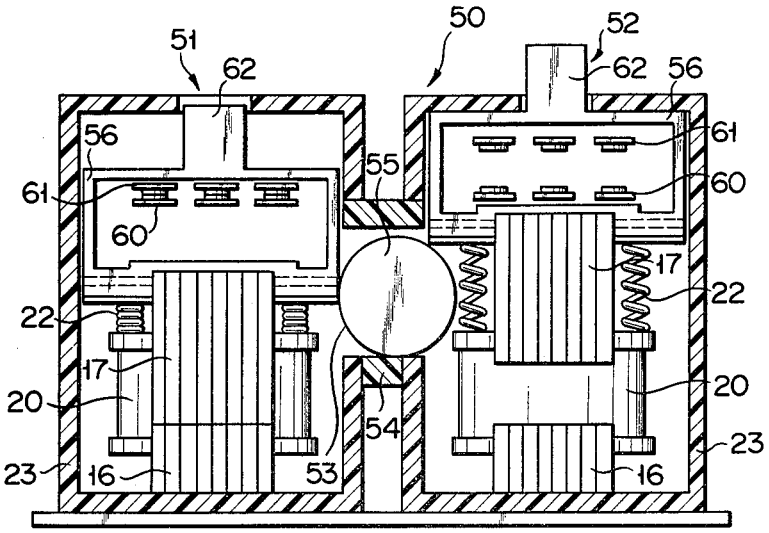
FIG. 7 is a partially sectioned front view showing operation of electromagnetic contactor of FIG. 2 when one of two units is excited.

When power is applied to the exciting coil 20 of first unit 51 of electromagnetic contactor 50 which is under such condition as shown in FIG. 2, the movable iron core 17 is pulled toward the fixed iron core 16 to contact with each other, as shown in FIG. 7, and movable contacts 61 attached via the spring 56*a* to the movable frame 56 contact fixed contacts 60 to close the line between terminals 58. The spring 56*a* urges movable contacts 61 against fixed contacts 60 to make both contacts 60 and 61 appropriately contacted with each other. The projection 62 of movable frame 56 is retracted inside the housing 23, showing the unit 51 operated. When the unit 51 is excited and the movable frame 56 is lowered, that lower end corner of movable frame 56 positioned on the side of roller 55 pushes down the roller 55 causing the roller 55 to move in right direction, so that the right side portion of roller 55 projects into the unit 52 to push up the lower left end corner of movable frame 56 so as to prevent the movable frame 56 from being lowered. Therefore, the unit 51 is kept under closed condition while the unit 52 under opened condition.

When excitation of unit 51 of electromagnetic contactor 50 which is under such condition as shown in FIG. 7 is stopped and the unit 52 is excited, the movable iron core 17 is separated from the fixed iron core 16 and lifted by the spring 22 while the movable iron core 17 of unit 52 is pulled toward the fixed iron core 16 to contact with each other. Therefore, the roller 55 is urged in left direction and an operation reverse to that shown in FIG. 7 is carried out, thus keeping the unit 51 under opened condition while the unit 52 under closed condition.

When one of units, the unit 51, for example, is excited and the other, the unit 52, for example, is under non-excited condition, the movable iron core 17 of unit 52 is not lowered even if exciting current should happen to flow through the coil 22 of unit 52 due to some causes such as operation error. It is because the pulling force between both iron cores 16 and 17 of unit 52 is much smaller than that between contacted iron cores 16 and 17 of unit 51 since the movable iron core 17 is separated from the fixed iron core 16 in the unit 51.

Even if units 51 and 52 should happen to be excited when both of them are kept under non-excited condition, there is no fear that they are brought into closed condition to close the power supply circuit connected to this electromagnetic contactor. It is because, when both of them are excited simultaneously, both of movable iron cores are lowered simultaneously to cause the roller 55 to be positioned in the center of through-groove 54*b* of connecting member 54 and both of movable frames 56 can not be therefore lowered enough leaving all pairs of contacts of units 51 and 52 not contacted.

The connecting member 54 and roller 55 employed in the embodiment shown in FIGS. 2–7 are as described referring to FIG. 5. However, when these connecting member 54 and roller 55 are employed, the roller 55 can freely come out of the through-groove 54*b* of connecting member 54 and assembly of electromagnetic contactor is not therefore easy.

Figure 8A:
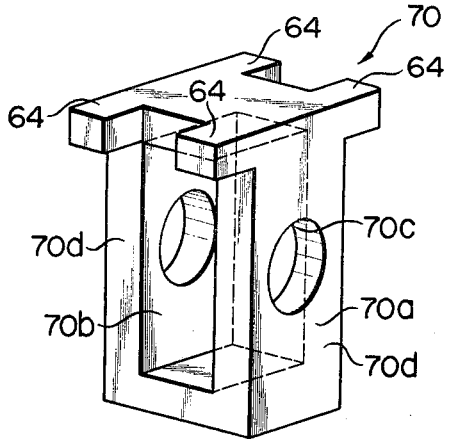
FIG. 8A is a perspective view showing another example of connecting member shown in FIG. 5.
Figure 8B:
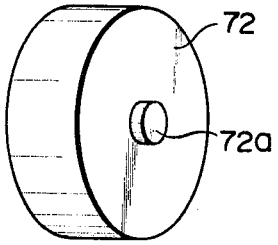
FIG. 8B is a perspective view showing a roller employed together with the connecting member shown in FIG. 8A.

FIGS. 8A, 8B, 9A and 9B show connecting members and rollers employed to avoid such drawback. The connecting member 70 and roller 72 shown in FIGS. 8A and 8B are substantially same as those shown in FIG. 5 but different in that relatively larger roller supporting holes 70*c* are formed in side walls 70*d* of body 70*a* of connecting member 70 and that a shaft 72*a* having a diameter smaller than that of roller supporting hole 70*c* and projecting from both sides of roller 72 is provided in the roller 72. The connecting member 70 and roller 72 are made of a somewhat resilient material such as plastics which can be resiliently deformed slightly by strong force. Therefore, the roller 72 can be positioned in the through-groove 70*b* with its shaft 72*a* projected into roller supporting holes 70*c* by so strongly forcing the roller 72 into the through-groove 70*b* of connecting member 70 as to cause some resilient deformation between the connecting member 70 and roller 72. When positioned in the through-groove 70*b*, the roller 72 can move along the throug-groove 70*b* at a range where the shaft 72*a* of roller 72 is allowed to move in roller supporting holes 70*c*. Therefore, it is possible that the roller 72 is designed to move by a distance necessary to interlock units 51 and 52 by appropriately selecting dimensions of roller supporting hole 70*c* and shaft 72*a*. In addition, the roller 72 can not freely come out of connecting member 70.

Figure 9A:
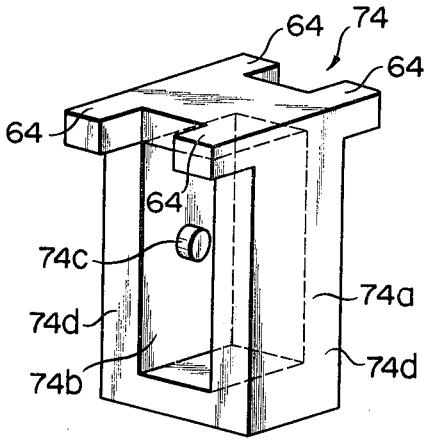
FIG. 9A is a perspective view showing other example of connecting member shown in FIG. 5.
Figure 9B:
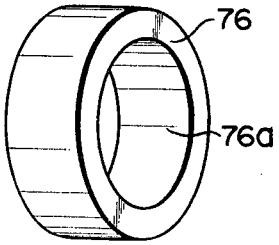
FIG. 9B is a perspective view showing another example of roller employed together with the connecting member shown in FIG. 9A.

The connecting member 74 and roller 76 shown in FIGS. 9A and 9B are made of same material as that of which those 70 and 72 shown in FIGS. 8A and 8B are made, but different from those 70 and 72 in that a rod 74*c* having a relatively small diameter is projected from each of inner faces of side walls 74*d* of the body 74*a* and that a hold 76*a* having a diameter larger than that of rod 74*c* is formed in the roller 76 coaxially with the outer circumference of roller. When forced into the through-groove 74*b* of connecting member 74, the roller 76 is somewhat resiliently deformed to come into the through-groove 74*b* and then returned to its original shape when it is positioned in the through-groove 74*b* with rods 74*c* projected into the hold 76*a*. When the connecting member 54 and roller 76 are under this condition, the roller 76 can move along the through-groove 74*b* at a range which is allowed by dimensions of rods 74*c* and hole 76*a*. Therefore, the roller 76 can be designed to move a distance necessary to interlock the electromagnetic contactor 50 by appropriately selecting the dimensions. In addition, the roller 76 can not freely come out of connecting member 54.

If the connecting member 70 or 74 and roller 72 or 76 are combined with each other, the roller can not freely come out of connecting member as in the case where the connecting member 54 and roller 55 shown in FIG. 5 are employed.

When one of units is excited, the embodiment of the present invention allows the movable iron core 17 and movable frame 56 of this excited unit to move and the lower end portion of movable frame 56 to force the roller 55, 72 or 76 into the other unit. It is therefore unnecessary to give a large play to the movement of movable iron core 17 as in conventional electromagnetic contactors. Further, the connecting member 54, 70 or 74 which can be made relatively small-sized and into which the roller 55, 72 or 76 is forced may be easily held between two units, so that the width of assembled electromagnetic contactor 50 can be made smaller than those of conventional ones. Furthermore, the position of roller is determined by the window 53 and connecting member 54, and the interlocking device 15 complicated in construction and employed in the conventional electromagnetic contactor 10 is not needed, so that assembly and adjustment of electromagnetic contactor 50 are easier as compared with those of conventional ones.

What is claimed is:

1. A reversible electromagnetic contactor comprising:

two electromagnetic contactor units each including a coil for exciting a fixed iron core, a movable iron core which is in a predetermined inoperative position when the fixed iron core is not excited but pulled toward the fixed iron core and contacted therewith when the fixed iron core is excited, and a spring means for urging the movable iron core to the inoperative position;

a roller;

a connecting member held between the two units and provided with a through-groove which holds the roller movable in any direction toward the both units; and holding means for pushing the roller toward the inoperative unit and holding the movable iron core of said unit in the inoperative position when the movable iron core of the other unit moves to the operative position;

wherein the distance in which the roller can move along the through-groove of the connecting member is made shorter than the diameter of said roller, and the holding means in each of the units is a movable frame attached to the movable iron core in each of the units and, when one of the units is excited, forces the roller into the other of units causing the roller to contact the movable frame of the other unit and to prevent the movement of this movable frame toward the operative position; and wherein the connecting member has two parallel side walls which define the through-groove, and roller supporting holes formed in the side walls to be aligned with each other, and the roller has a shaft whose diameter is smaller than that of the roller supporting hole, and said connecting member and roller are made of somewhat resilient material permitting the roller to be forced into the through-groove of the connecting member in such a way that the roller can be positioned in the through-groove with its shaft projected into the roller supporting holes so as not to freely come out of the through-groove.

2. A reversible electromagnetic contactor comprising:

two electromagnetic contactor unit each including a coil for exciting a fixed iron core, a movable iron core which is in a predetermined inoperative position when the fixed iron core is not excited but pulled toward the fixed iron core and contacted therewith when the fixed iron core is excited, and a spring means for urging the movable iron core to the inoperative position;

a roller;

a connecting member held between the two units and provided with a through-groove which holds the roller movable in any direction toward the both units; and holding means for pushing the roller toward the inoperative unit and holding the movable iron core of this unit in the inoperative position when the movable iron core of the other unit moves to the operative position;

wherein the distance in which the roller can move along the through-groove of the connecting member is made shorter than the diameter of said roller, and the holding means in each of the units is a movable frame attached to the movable iron core in each of the units and, when one of the units is excited, forces the roller into the other of units causing the roller to contact the movable frame of the other unit and to prevent the movement of this movable frame toward the operative position; and wherein the connecting member has two parallel side walls which define the through-groove, and two rods projected opposite fom the inner faces of side walls, and the roller has a hole formed coaxially therewith and having a diameter larger than that of the rod, and said connecting member and roller are made of a somewhat resilient material permitting the roller to be forced into the through-groove of the connecting member in such a way that the roller can be positioned in the through-groove with the rods projected into its hole so as not to freely come out of the through-groove.

* * * * *